US006178951B1

(12) United States Patent
Doreau et al.

(10) Patent No.: US 6,178,951 B1
(45) Date of Patent: Jan. 30, 2001

(54) DIRECT INJECTION FUEL PUMP FOR ENGINE WITH CONTROLLED IGNITION AND INJECTION SYSTEM COMPRISING SAME

(75) Inventors: Jean Doreau, Vigny; Michel Poirier, Pontoise; Jérôme Piaton, Montlucon, all of (FR)

(73) Assignee: Sagem SA (FR)

( * ) Notice: Under 35 U.S.C. 154(b), the term of this patent shall be extended for 0 days.

(21) Appl. No.: 09/462,275

(22) PCT Filed: Jul. 7, 1998

(86) PCT No.: PCT/FR98/01451

§ 371 Date: Feb. 11, 2000

§ 102(e) Date: Feb. 11, 2000

(87) PCT Pub. No.: WO99/02851

PCT Pub. Date: Jan. 21, 1999

(30) Foreign Application Priority Data

Jul. 7, 1997 (FR) ..... 97 08595

(51) Int. Cl.[7] ..... F02M 33/04; F04B 9/08

(52) U.S. Cl. ..... 123/495; 417/385

(58) Field of Search ..... 123/495, 496; 417/385, 387, 390

(56) References Cited

U.S. PATENT DOCUMENTS

| | | | | |
|---|---|---|---|---|
| 2,960,936 | * | 11/1960 | Dean et al. . | |
| 3,433,161 | * | 3/1969 | Vetter . | |
| 3,918,846 | * | 11/1975 | Winkler | 417/386 |
| 5,249,932 | * | 10/1993 | Van Bork | 417/385 |
| 5,421,710 | * | 6/1995 | Yorita | 417/385 |
| 5,520,523 | * | 5/1996 | Yorita et al. | 417/387 |
| 5,899,671 | * | 5/1999 | Horn | 417/387 |
| 6,113,361 | * | 9/2000 | Djordjevic | 417/385 |

* cited by examiner

*Primary Examiner*—Thomas N. Moulis
(74) *Attorney, Agent, or Firm*—Larson & Taylor, PLC

(57) ABSTRACT

An injection pump comprises several modules in a housing. Each module has a chamber supplying an injection circuit, separated by a deformable diaphragm from a compartment defined by a bore of the housing and by a reciprocating piston. The chamber is connected to a fuel supply and is connected to the injection circuit by a non-return valve. The pressures of the liquid in each compartment are adjusted independently. All pistons are driven by a same cam.

6 Claims, 2 Drawing Sheets

FIG.4.
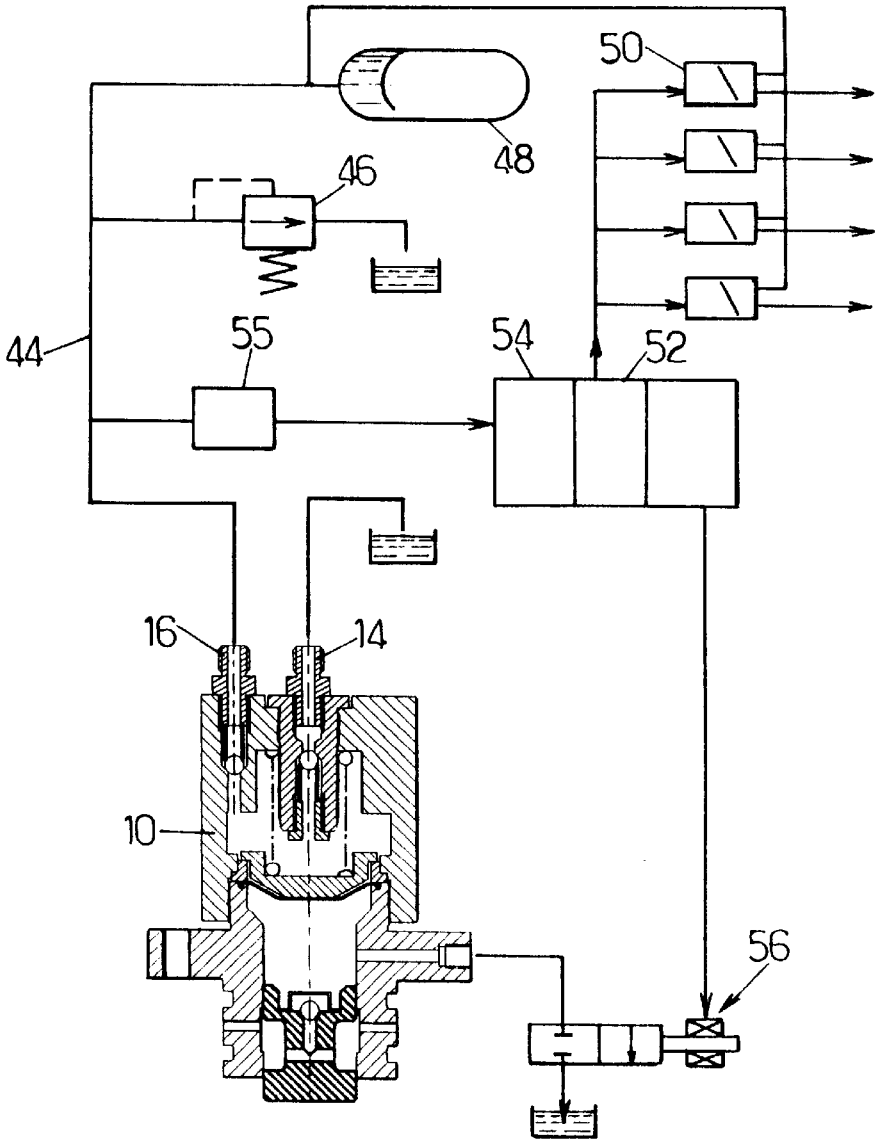
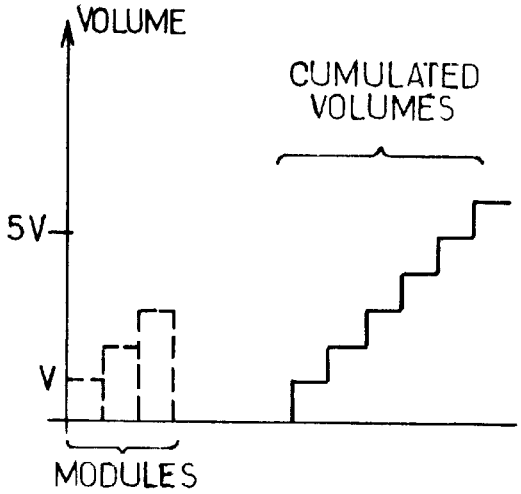
FIG.5.

DIRECT INJECTION FUEL PUMP FOR ENGINE WITH CONTROLLED IGNITION AND INJECTION SYSTEM COMPRISING SAME

BACKGROUND OF THE INVENTION

The invention relates to pumps designed to inject fuel directly into the combustion chambers of a spark ignition engine. Unlike the diesel fuel used with diesel engines, the fuels used in spark ignition engines (gasoline and liquefied petroleum gas) do not lubricate the surfaces with which they are in contact. Piston-operated positive displacement pumps compress the fuel directly, incurring a risk of seizing. Furthermore, the only way of controlling the pressure of these pumps, the cylinder capacity of which is fixed, is by dissipating energy in a return path, which impairs the energy yield, heats the fuel and can give rise to cavitation.

In order to reduce the risk of seizing, a pump has already been proposed (FR-A-2 603 347) which has fuel compression chambers, each of which is bounded by a diaphragm separated by hydraulic fluid from a piston driven by a rotating plate. The stroke of the piston and the volume of liquid occupying the compartment defined by the piston and the diaphragm is constant, which does not resolve the problem of regulating the delivery rate and injection pressure.

An injection pump is also known (U.S. Pat. No. 5,520,523) which has a supply chamber for feeding an injection circuit, separated by a diaphragm from a compartment defined by a bore in the housing and by a piston arranged to be reciprocated during operation. The chamber is connected to a fuel supply and to the injection circuit by non-return valves. The pressure of the liquid occupying the compartment can be adjusted.

SUMMARY OF THE INVENTION

The purpose of the present invention is to provide a high-pressure injection pump which better meets practical requirements than those previously known, in particular because it allows the volume displaced by the pump to be regulated in a simple manner by means of a structure which practically eliminates the risk of seizing.

In particular, the invention proposes a pump comprising a plurality of modules in a housing each having at least one chamber for supplying a fuel injection circuit, each of said chambers being separated by a deformable diaphragm from a compartment defined by a respective bore in the housing and by a piston activated reciprocably mounted in said bore. A common member drives all pistons. Each chamber is connected to a fuel supply by an inlet and non-return valves for connect the chambers to the injection circuit. Means are provided for independently adjusting a liquid pressure in each of said compartments.

It will be seen that the invention imparts to each intermediate chamber occupied by a hydraulic fluid, which has a lubricating effect, an adjustment action in addition to its anti-seizing action. This adjusting action may be applied gradually or on an all or nothing basis.

In the latter case, it is sufficient to connect one of the compartments to discharge to suppress delivery of a flow by the corresponding module.

In the first case, a gradual action can be produced by adjusting the cross-section of a return leakage of the hydraulic fluid to the discharge by means of an analogue or step by step controlled solenoid. The presence of a leakage reduces the amount of displacement of the diaphragm by the piston.

Each of the modules may be assigned to a combustion chamber of the engine. However, it is more advantageous to provide several injectors individually controlled, generally by electromagnetic means, which will permit the use of a single supply of pressurized fuel.

The modules may be connected to a common injection rail supplying all the injectors, the number of units in service being selected as a function of the operating speed of the engine.

Any one of the units can be put out of operation , simply by connecting the compartment to the discharge.

Pump operation can consequently be adjusted in a very simple manner to take account of the load conditions of the engine and in particular to provide an easy means of obtaining a lean mixture at nominal speed, produced by direct injection, and a rich mixture when starting the engine or during transitory conditions. This all or nothing adjustment may be used in conjunction with the gradual adjustment by continuously adjusting the pressure or substituted to it.

It is of particular advantage to use several modules with supply compartments having different cross-sections and/or different capacities. A graded system of this type enables the global yield and the regularity of the mechanical drive torque to be optimised by an appropriate selection of the modules activated.

The above features and others will become more apparent from the following description of specific embodiments, given by way of example and not restrictive in any respect. The description is given with reference to the appended drawings.

BRIEF DESCRIPTION OF THE DRAWINGS

FIG. 4 is an overall diagram of an injection system having a pump of the type illustrated in FIG. 1;

FIG. 5 illustrates one possible distribution of the cylinder capacities of several units belonging to a same pump.

DETAILED DESCRIPTION OF A PREFERRED EMBODIMENT

Figure 1:
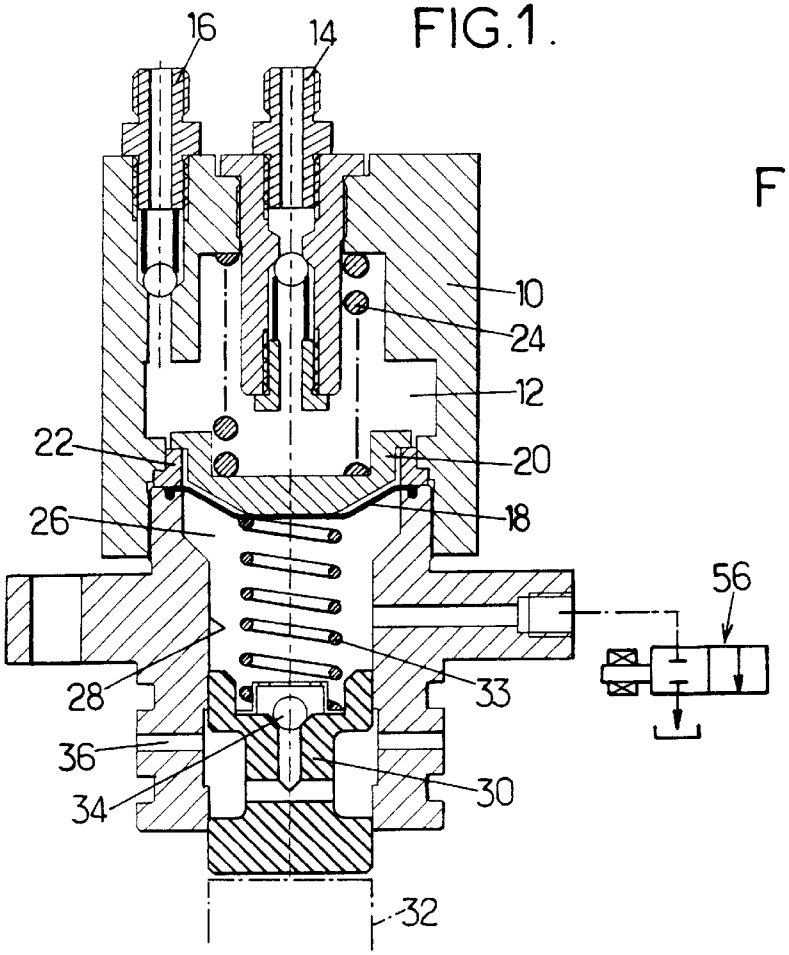
FIG. 1 is a schematic view in cross-section of the hydraulic part of a pump unit or module.

The pump module schematically illustrated in FIG. 1 comprises a housing 10 in a plurality of assembled parts, defining a supply chamber 12 for delivery of high-pressure fuel. The chamber 12 communicates with the outside by an inlet connector 14 and a delivery connector 16. Non-return valves are inserted between the connectors and the chamber 12.

The supply chamber 12 has a moving wall comprising a flexible diaphragm 18, generally made from elastomere material. The periphery of the diaphragm 18 is clamped between two parts of the housing 10. Supported on the diaphragm 18 is a cup 20 having an edge portion arranged to bear on a stop ring 22 of the housing. A return spring 24 urges the edge of the washer against the stop ring 22, thereby fixing the rest position of the diaphragm.

The diaphragm 18 separates the chamber 12 from a compartment 26 defined by a bore 28 provided in the housing and by a piston 30 which has a reciprocating motion when the pump is operating, generally by means of a rotating cam 32. A spring 33, which applies a lower force than the spring 24, biases the piston 30 into contact with the cam 32.

The compartment 26 is designed to contain hydraulic liquid (which might be engine oil) at a pressure which is adjustable either gradually or on all or nothing basis. In the first instance, the effective amount of displacement of the diaphragm 18 responsive to the reciprocating movement of the piston and hence the flow rate of the pump can be gradually adjusted.

The pressure in the compartment 26 may be switched by means of a three-way electrically operated or solenoid valve. This valve may be provided as a means of isolating the chamber 26, connecting it to a source at given pressure or connecting it to a discharge tank. The compartment 26 is connected by a non-return admission valve 34 to a source such as an engine oil inlet 36.

In order to obtain a nominal delivery rate for a given rotational speed of the cam 32, it is sufficient to allow the pressure in the compartment 26 to set of freely. The cup 20 is moved into abutment against the ring 22 with the piston moves back. As the piston advances, the diaphragm 18 is displaced, the pressures against the two surfaces thereof remaining balanced.

The pump has several units, each having a supply chamber 12 and a compartment 26. In the case illustrated in FIG. 2, where the components illustrated in FIG. 1 are denoted by the same reference numbers, the chambers 12 are arranged side by side and the cups 20 are displaced in the vertical direction of the drawing. On the other hand the pistons 30 move in opposite directions in radially arranged bores and are controlled by a same cam 32 or plate. In modified embodiment, the pistons move parallel with one another in a same axial direction.

Figure 3:
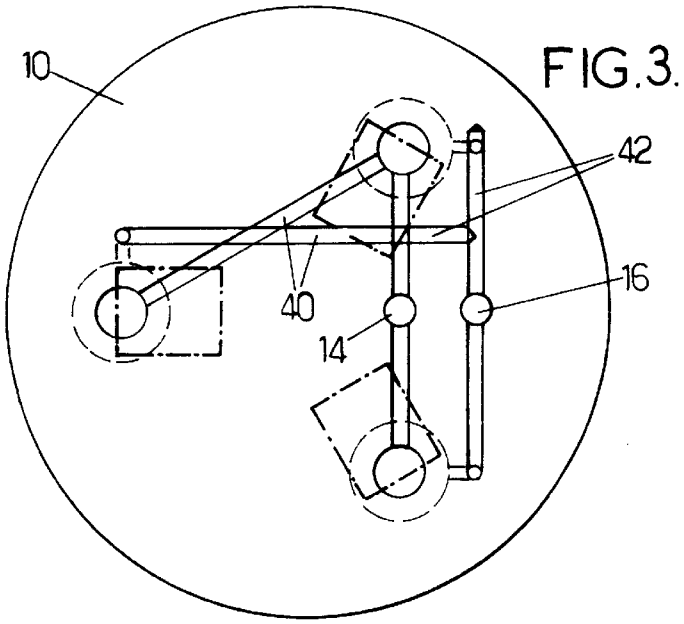
FIG. 3 is a schematic plan view of FIG. 2.

The connections between the chambers 12 may be those illustrated in FIG. 3 if the pump has three units, evenly distributed around the axis of the housing 10. The inlet connector 14 is connected via respective non-return valves to the chambers by means of two ports 40 of the housing laid out in a V arrangement. The delivery connector 16 is connected by means of mutually orthogonal ports 42 to chambers 43 arranged at the outlet of the chambers 12. To ensure that they can be machined, the ports open at the periphery of the casing by extensions, not illustrated, closed off by plugs.

FIG. 4 illustrates, by way of example, an injection system using a pump of the type illustrated in FIG. 1 (a single module only being illustrated). The delivery connector 16 is connected to a distribution rail 44 provided with a safety valve 46 to avoid excessive pressure and an accumulator 48. The distribution rail supplies the injectors 50, which are opened in sequence by an electric pulse generator 52 controlled by a computer 54, in which a software setting the control strategy for the injectors and pump is loaded. The computer 54 may be of any general conventional construction. It receives signals representative of engine operating parameters (position of a butterfly valve, angular position of the engine flywheel, composition of the exhaust gas, etc.) as well as the output signal from a sensor 55 detecting the pressure prevailing in the distribution rail 44. From these data, the computer derives the flow rate to be delivered by the pump and controls the solenoid valve 56 accordingly. The solenoid valve 56 may be controlled by the control computer 54 at a much lower frequency than the activation frequency of the pump. Due to the fact that the delivery rate is controlled by adjusting the effective displacement of the diaphragm and hence the volume delivered for one reciprocating movement of the piston, there is no head loss comparable to that caused by throttling fuel on a return travel to the tank.

Figure 2:
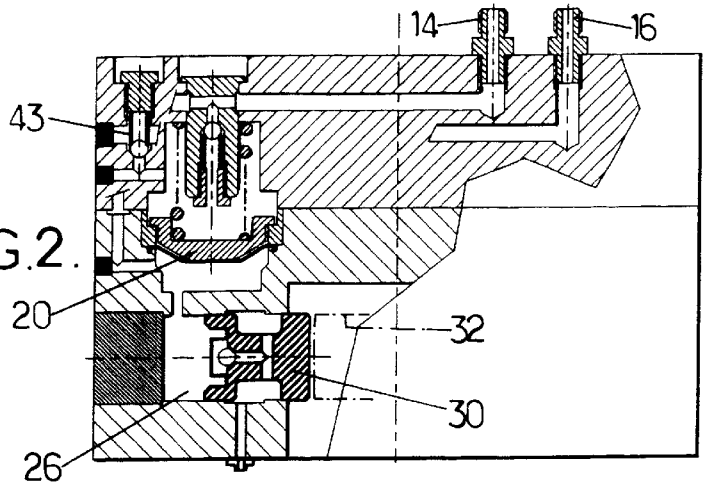
FIG. 2 is a partial view in section of a pump comprising several units connected to a supply and a common distribution rail.

In general, the pump will have several units or modules, i.e. will be constructed as illustrated in FIGS. 2 and 3. Each unit will be provided with its own solenoid 56 or its own distributor and may be controlled on an all or nothing basis.

Advantageously, the units or modules have different compartments 28 and chambers 12. The pistons of the different units may be of different diameters and in particular the contact surfaces with the liquid will vary in a geometric progression. A difference between the surfaces of the diaphragms will cause different flow rates for a same rotational speed of the cam and for the same piston travel simply by connecting one or more of the compartments to the discharge. Accordingly,it is possible to achieve a progressive law of variation of the flow rate, in particular by scaling the surfaces conforming to a geometric progression. If, for example, the capacities of three units have values V, 2V and 3V as illustrated by broken lines in FIG. 5, scaled flow rates can be obtained, ranging, per cycle, from V to 6V.

Other distributions of cylinder capacities would also be possible. For example, with individual volumes V, 2V and 8V, it would be possible to produce a variation in volume ranging from 1V to 11V, simply by providing a discontinuity between 3V and 8V, which is often acceptable.

What is claimed is:

1. A fuel injection pump comprising:

a housing, a plurality of modules in said housing each having at least one chamber for supplying a fuel injection circuit, each of said chambers being separated by a deformable diaphragm from a compartment defined by a respective bore in the housing and by a piston reciprocably mounted in said bore, a common member for driving all of said pistons, non-return means for connecting each of said chambers to a fuel supply, non-return valve means for connecting each of said chambers to the injection circuit,and means for independently adjusting a liquid pressure in each of said compartments.

2. A pump according to claim 1, wherein each of said compartments is connected to a hydraulic fluid admission via a non-return valve and a solenoid valve operable for either isolating the compartment and discharging said compartment.

3. A pump according to claim 1, wherein each of said chambers contains a cup, a spring for urging said cup into abutment against a respective one of said diaphragms and means restricting an amount of displacement which imposed by the cup to the diaphragm.

4. A pump according to claim 1, wherein all said supply chambers are connected to one another.

5. A pump according to claim 4, wherein the pistons of the different modules are of different diameters.

6. A pump according to claim 4, wherein the pistons have mutually different contact surface areas with the liquid.

* * * * *